US007302810B2

(12) United States Patent
McCrory

(10) Patent No.: US 7,302,810 B2
(45) Date of Patent: Dec. 4, 2007

(54) QUILTED COOLER WITH INSULATING GEL LINER

(76) Inventor: John McCrory, 111 Erick St., #123, Crystal Lake, IL (US) 60014

( * ) Notice: Subject to any disclaimer, the term of this patent is extended or adjusted under 35 U.S.C. 154(b) by 0 days.

(21) Appl. No.: 10/715,037

(22) Filed: Nov. 17, 2003

(65) Prior Publication Data

US 2005/0103043 A1 May 19, 2005

(51) Int. Cl.
*F25D 3/08* (2006.01)

(52) U.S. Cl. ..... 62/457.2

(58) Field of Classification Search ..... 62/457.1–457.9
See application file for complete search history.

(56) References Cited

U.S. PATENT DOCUMENTS 5,361,603 A * 11/1994 Merritt-Munson ..... 62/457.2
5,490,396 A * 2/1996 Morris ..... 62/457.2
5,562,228 A * 10/1996 Ericson ..... 62/457.2
6,048,099 A * 4/2000 Muffett et al. ..... 383/20
6,068,402 A * 5/2000 Freese et al. ..... 383/110
6,422,032 B1 * 7/2002 Greene ..... 62/457.2
6,474,095 B1 * 11/2002 Chan ..... 62/457.2

* cited by examiner

*Primary Examiner*—Melvin Jones
(74) *Attorney, Agent, or Firm*—Gerry Fischer

(57) ABSTRACT

A cooler is provided including a sidewall portion including an outer layer and an inner layer quilted to form a plurality of gel pockets and gel disposed in the plurality of gel pockets, wherein the cooler is foldable along regions between the gel pockets. In one embodiment, the gel is a saline solution. In another embodiment, the cooler further includes a bottom flap foldably attached to a seam between a bottom and the sidewall.

14 Claims, 5 Drawing Sheets

QUILTED COOLER WITH INSULATING GEL LINER

BACKGROUND OF INVENTION

Field of the Invention

The invention relates to coolers. More specifically, the invention relates to a quilted cooler with insulating gel liners.

Coolers have been used to maintain food and beverages at a temperature cooler than ambient temperatures for many years. Prior art coolers feature rigid sidewalls and lids, with the sidewalls designed to insulate the interior from ambient temperatures. Ice, or other cold substances, may then be inserted into the cooler, to keep the interior colder than ambient temperatures.

Rigid walls are not always desirable, and soft-sidewall coolers have been offered. These coolers have become popular, and may be reduced in size for storage.

Insulating gels have become popular, and are used as a substitute for ice, to avoid creating water when the ice melts. These gels are wrapped in a wrapper, such as plastics, and then inserted into the interior of coolers to reduce temperatures in the interior of the cooler. The wrapped gels, also called a gel pack, are placed in a freezer prior to insertion into the cooler.

Using the wrapped gels, however, has a disadvantage, in that the packages tend to be small, and easily lost or discarded. This is especially true for small children, who may be sent to school with the gel packs in their lunch box. Furthermore, insertion of wrapped gels may cause damage to food in the cooler, and the wrapped gel will occupy volume inside the cooler.

Resolving the "lost pack" problem has resulted in gel packs incorporated into the walls of soft-sidewall coolers. This solution works well, unless the cooler is placed in a freezer, whereby the gel can freeze. If a gel-pack soft-sidewall cooler is to be placed in the freezer, the cooler must be fully expanded to its operational size (taking up a potentially significant volume of freezer space). If the gel-pack soft-sidewall cooler is placed in the freezer to freeze, the cooler will not be able to assume an operational size without breaking the now-frozen gel and potentially damaging the cooler.

A new gel-pack soft-sidewall cooler that allows the cooler to be placed in the freezer while occupying a minimal volume is desirable.

SUMMARY OF THE INVENTION

A cooler comprising a sidewall portion including an outer layer and an inner layer is disclosed. The outer layer and inner layer are quilted to form at least one gel pocket. Gel is disposed in the gel pockets, so that the cooler is foldable along regions between the gel pockets.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE INVENTION

Figure 1:
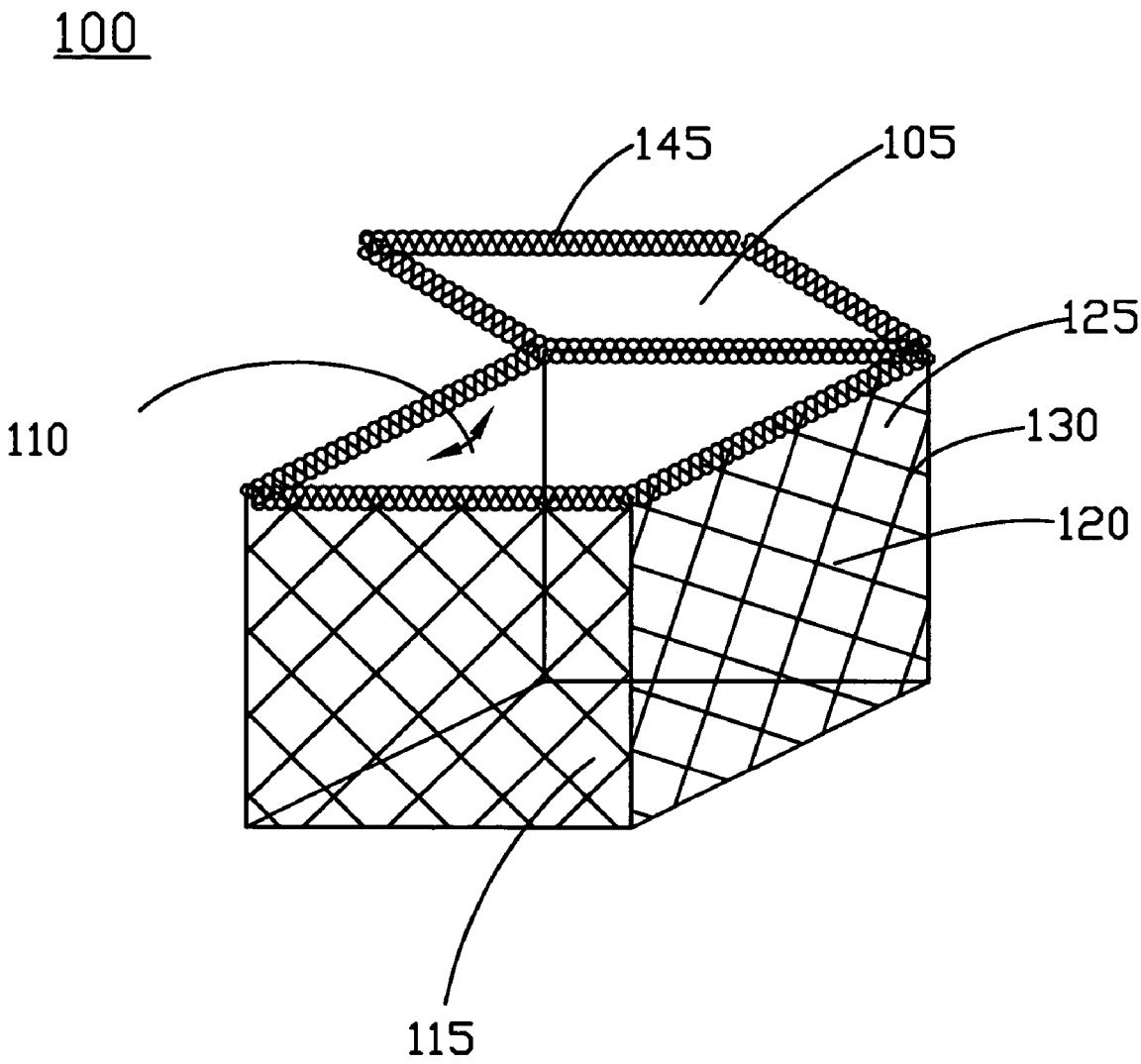
FIG. 1 illustrates a cooler in accordance with one embodiment of the invention.
Figure 2:
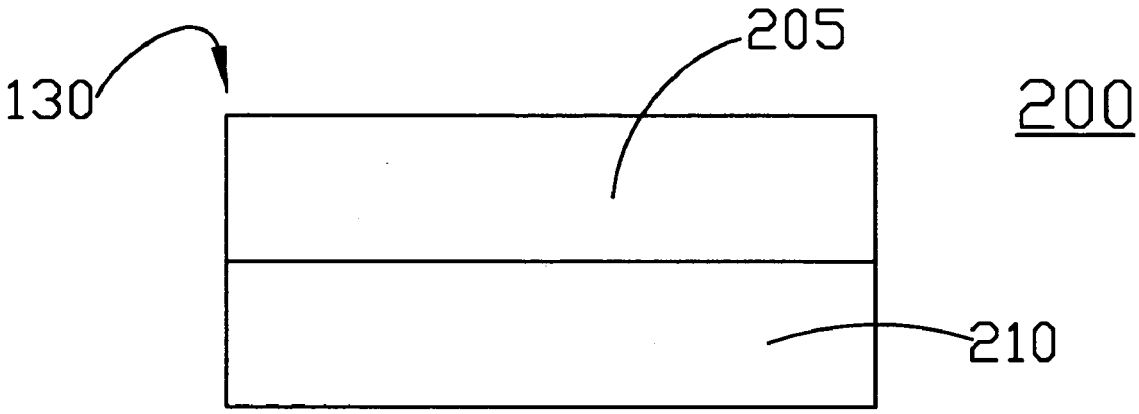
FIG. 2 illustrates cross sectional view of the sidewalls of the cooler illustrated in FIG. 1 in accordance with one embodiment of the invention.
Figure 3:
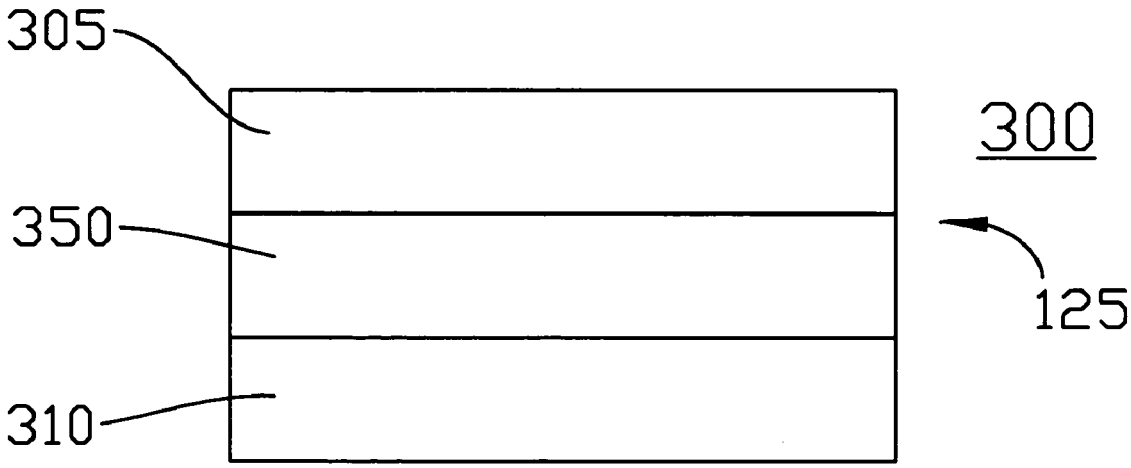
FIG. 3 illustrates cross sectional view of the sidewalls of the cooler illustrated in FIG. 1 in accordance with one embodiment of the invention.

FIG. 1 illustrates one embodiment of a cooler in accordance with the invention at 100. Cooler 100 comprises lid 105, bottom 115, and a plurality of sidewalls 120. Sidewalls 120 comprise gel filled portions 125 and interstitial portions 130. Cooler 100 further includes an interior region 110 that is temperature insulated from ambient temperatures by the lid 105, bottom 115 and the sidewalls 120. FIG. 2 illustrates a cross-sectional view of sidewalls 120 at an interstitial portion 130. FIG. 2 illustrates that sidewalls 120 further comprise an inner layer 210 and an outer layer 205 at the interstitial portions 130. FIG. 3 illustrates a cross-sectional view of sidewalls 120 at gel filled portions 125. FIG. 3 illustrates that at the gel filled portions 125, the sidewalls 120 comprise an inner layer 310, an outer layer 305, and a gel layer 350. Gel layer 350 is disposed between the inner layer 310 and the outer layer 305.

Figure 4:
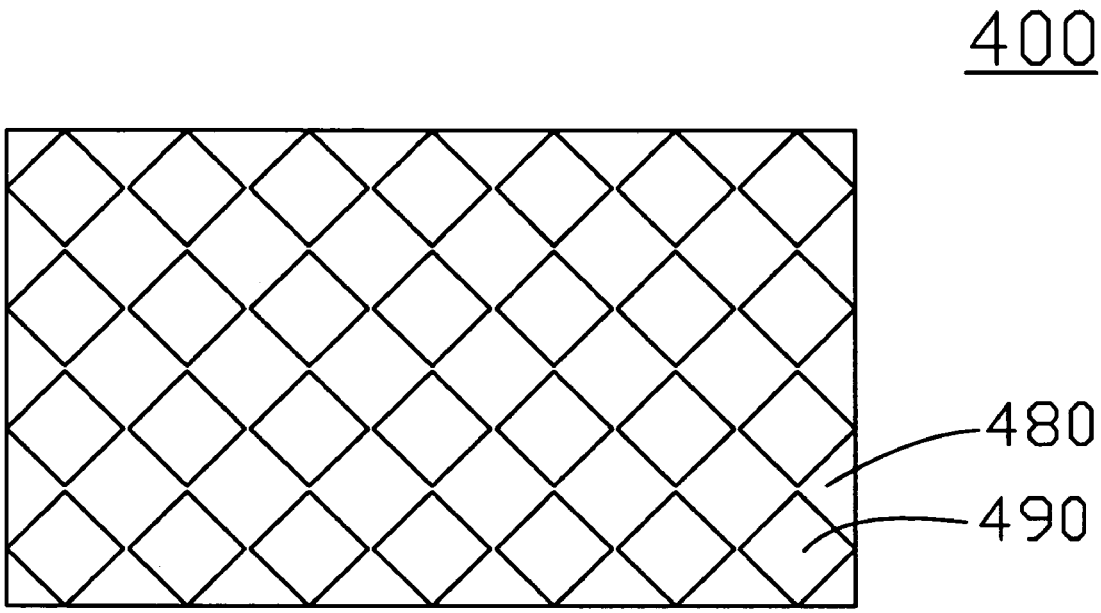
FIG. 4 illustrates a detailed view of the cooler illustrated in FIG. 1, in accordance with one embodiment of the invention.
Figure 5:
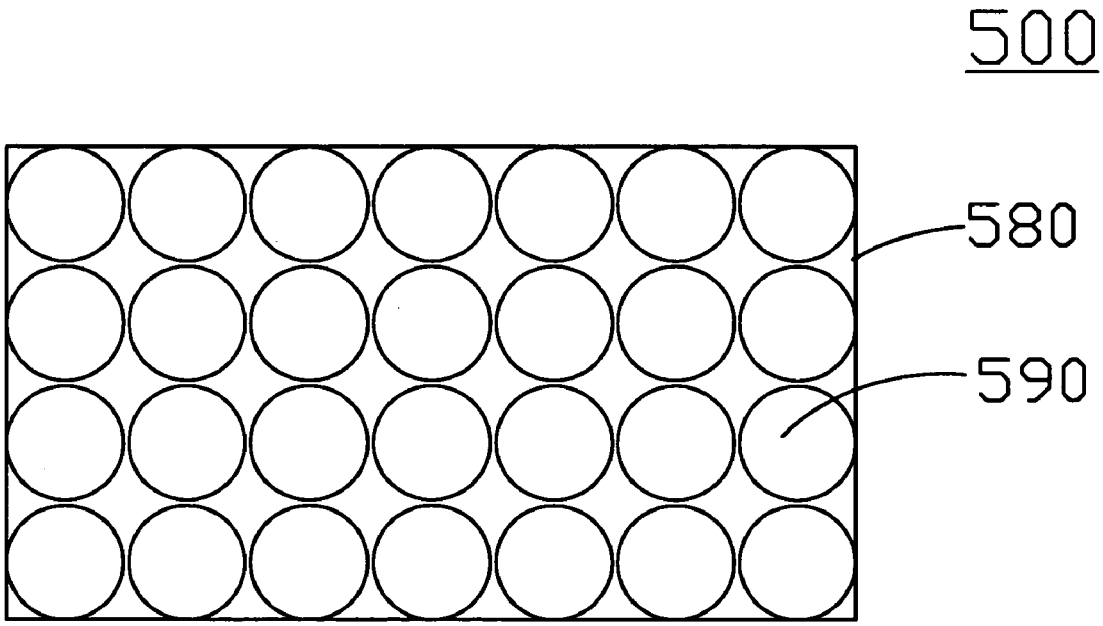
FIG. 5 illustrates a detailed view of the cooler illustrated in FIG. 1, in accordance with another embodiment of the invention.

FIG. 4 illustrates a close up view of sidewall 120 of FIG. 1, in accordance with one embodiment of the invention. In FIG. 4, gel filled portions 490 and interstitial portions 480 are arranged in a diamond shaped lattice. FIG. 5 illustrates a close up view of sidewall 120 of FIG. 1, in accordance with another embodiment of the invention. In FIG. 5, gel filled portions 590 and interstitial portions 580 are arranged in a lattice with substantially circular gel filled portions 590. Those of ordinary skill in the art will readily recognize that the gel filled portions may comprise a variety of other shapes including rounded shapes as well as a polygon with at least 3 sidewalls.

When frozen, the sidewalls 120 of the quilted cooler shown in FIG. 1, may be folded and unfolded without breaking the frozen gel, and with a reduced chance of damage to the quilted cooler 100. The sidewalls are folded along the interstitial portions 130 (as shown in FIG. 1), and thus the folds do not crease the gel filled portions 125. Folding the sidewalls 120 allows the quilted cooler to be frozen in a disposition that minimizes displaced volume, while maintaining the desired gel filled thickness.

The lid 105 and bottom 115 (as illustrated in FIG. 1) may be constructed in the fashion described for sidewalls 120. Thus, the lid 105 and bottom 115 may also comprise interstitial portions and gel filled portions such that the lid 105 and bottom 115 are foldable along the interstitial portions.

FIG. 1 illustrates the cooler with 4 sidewalls 120. The sidewalls 120 are fixedly connected to bottom 115. The sidewalls 120 are sealably connected, in one embodiment, to the lid 105. In FIG. 1, the sealable connection is illustrated as a zipper connection 145, but any sealable connection is appropriate. In other embodiments, lid 105 may be connected to sidewalls 120 by snaps, Velcro® brand fasteners, latches or another appropriate sealable connector as known to those of ordinary skill in the art.

The width and length of the gel filled portions illustrated in FIGS. 1-5 is a design choice. In one embodiment, the gel filled portions are about 1 cm long and 1 cm wide, with an area 1 $cm^2$. In another embodiment, the gel filled portion is substantially circular. Similarly, the width and length of interstitial regions is also a design choice. In one embodiment, the interstitial region is about 0.5 cm wide and about 0.5 cm long. In another embodiment, the interstitial region is longer than the interstitial region is wide. In one embodiment, each sidewall 120 comprises two gel filled portions, the gel filled portions substantially rectangular, with the width of the gel filled portion shorter than the height of the gel filled portion. In another embodiment, the cooler is constructed with opposing sidewalls including at least a long pair of walls and a short pair of walls, wherein the long pair of walls comprises two gel filled portions in each wall and the short pair of walls comprises a single gel filled portions in each wall.

The sidewalls 120, lid 105 and bottom 115 may be constructed from any appropriate material including vinyl, nylon, PVC, cardboard, paper, burlap and plastic. Other materials will be apparent to those of ordinary skill in the art, and are included herein. In one embodiment, the inner portion of sidewall 120 comprises food grade PVC. The sidewalls 120, lid 105 and bottom 115 may be the same material, or different. The insulating gel may be any insulating gel known to those of ordinary skill in the art. In one embodiment, the gel is a saline solution. In another embodiment, the gel is water. In another embodiment, the gel is any substance that is configured to freeze at a temperature approximately the same as the freezing temperature of water. In another embodiment, the gel is a substance configured to freeze in an ordinary household freezer, as is known to those of ordinary skill in the art. In one embodiment, the quilted cooler is substantially 12"×12"×12". In one embodiment, the cooler is sized to contain twelve 12-ounce beverage cans, as known to those of ordinary skill in the art. In other embodiments, the quilted cooler is any size desired.

The gel filled portions and interstitial portions are formed by quilting the inner and outer layers together, forming a plurality of gel pockets. Quilting the layers may be done with any known quilting technique as known to those of ordinary skill in the art. In one embodiment, the layers are quilted together with stitching. In another embodiment, the layers are quilted together with a hot press. In another embodiment, the layers are quilted together with a heat seal.

In another embodiment, the outer layer is covered by a surface wrap. In an embodiment using a surface wrap, the cooler is further insulated, and the quilting of the layers is not visible from the outside when the cooler is closed. In one embodiment, the outer layer comprises nylon, although any other appropriate material may be used to construct the outer wall. Such other materials include PVC. The outer layer, in one embodiment, further includes at least one insulation barrier between the gel filled portion and the outer layer, creating a multi-layer outer layer.

A cooler constructed according to this invention may include a number of other features, including but not limited to, pockets on the exterior of the cooler, shoulder or carrying straps, and elastic cords. Multiple additional features may be added. Embodiments featuring an external pocket may have sealable pockets, or the pockets may be unsealable and lack sealing means. External pockets may be sealed with zippers, Velcro or other sealing means known to those of ordinary skill in the art.

Figure 6A:
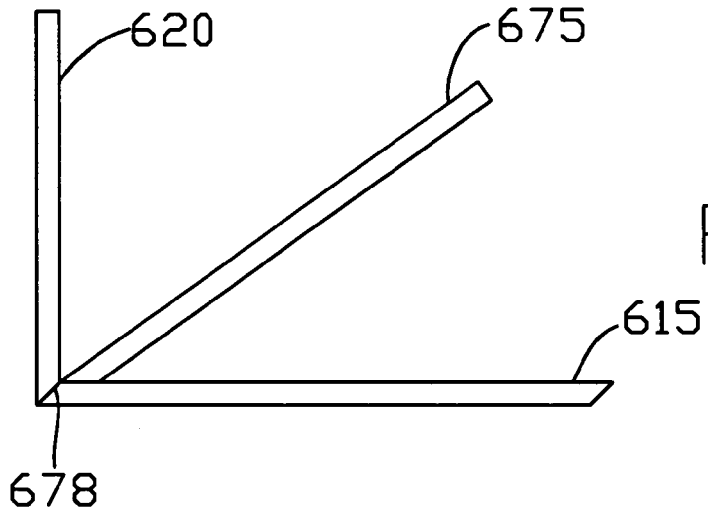
FIG. 6A illustrates another embodiment of the invention.
Figure 6B:
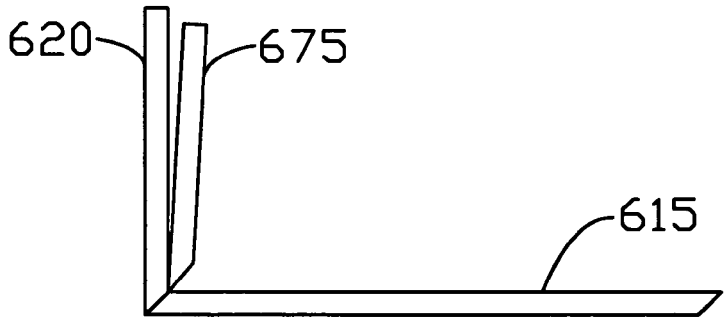
FIG. 6B illustrates a bottom flap in a vertical position.
Figure 6C:
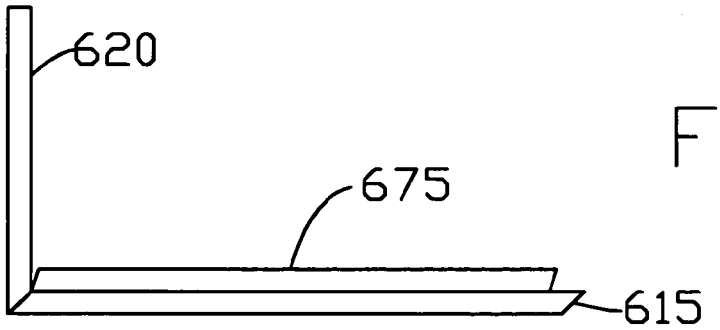
FIG. 6C illustrates a bottom flap in a horizontal position.

FIG. 6A illustrates a bottom flap in accordance with another embodiment of the invention at 600. As illustrated in cutaway in FIG. 6, the cooler comprises a bottom 615 and sidewall 620. Bottom flap 675 is shown foldably connected to position 678 where bottom 615 and sidewall 620 connect. Bottom flap 675 is connected to position 678 to facilitate folding flap 675 up and down and to a plurality of locations between up and down. Bottom flap 675 is constructed of a relatively rigid material and is configured to provide a more rigid bottom when the cooler is being used to cool items, while simultaneously being configured to allow the cooler to be collapsed when not in use. FIG. 6B shows bottom flap 675 in a vertical position, suitable for the cooler to be collapsed. FIG. 6C illustrates the bottom flap 675 in a horizontal position, suitable for when the cooler is in use and providing additional support to any contents of the cooler. In one embodiment, the bottom flap is sized to fit against the inner surface of the sidewall at the terminus of the bottom, such that the bottom flap covers substantially all of an inner surface of the bottom. In another embodiment, the bottom flap does not cover the entire at least some of the inner surface of the bottom.

Figure 7:
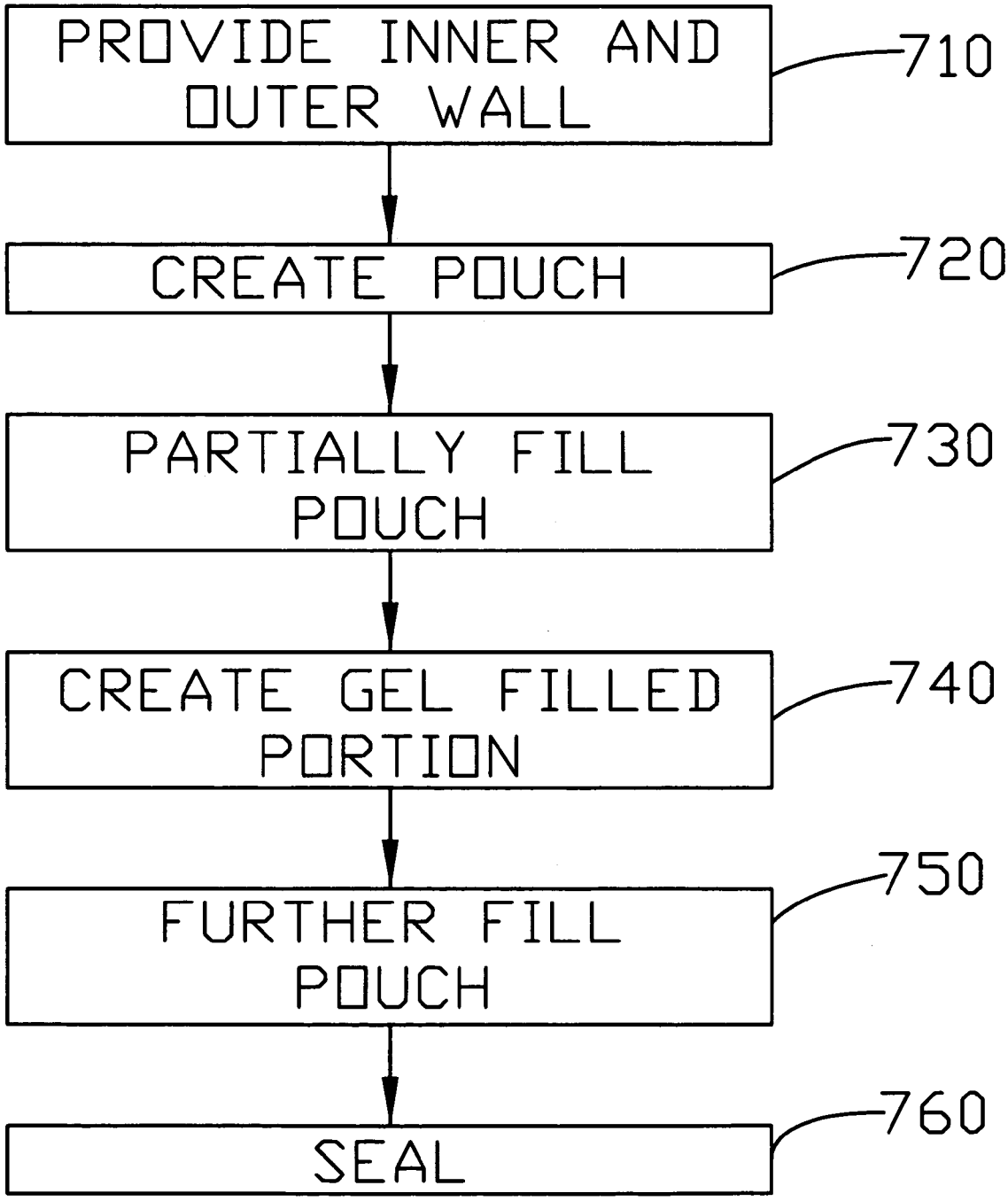
FIG. 7 illustrates a method of constructing a cooler in accordance with another aspect of the invention.

FIG. 7 illustrates one embodiment of a method for constructing a cooler in accordance with the invention at 700. At step 710, an inner wall and an outer wall are provided. In one embodiment, these are the inner layer and the outer layer. In one embodiment, the inner wall and outer wall comprise food grade PVC.

At step 720, the inner wall and outer wall are used to create a pouch. The pouch, in one embodiment, is created by sealing bottom edges and side edges to create a pouch with a bottom and side walls, with an open upper edge. In one embodiment, the pouch is created by heat sealing the inner and outer layers together.

At step 730, the pouch is partially filled with insulating gel. The gel, for example is a saline solution or water. At step 740, a first gel filled portion is created by latitudinal seals of the gel between the bottom of the pouch and the top of the pouch. This sealing creates a gel filled portion at the bottom of the pouch and leaves a portion of the pouch open and available to receive further amounts of the gel. In one embodiment, hot sealing the inner and outer walls together creates the seal.

At step 750, the pouch is filled with additional gel. At step 760, the additional gel is sealed, creating a second gel filled portion of the pouch. Steps 750 and 760 are repeated to create the desired, predetermined number of gel filled portions, or until the pouch is filled with gel.

In one embodiment of the invention, multiple pouches are created for each sidewall. In one such embodiment, the inner and outer walls are heat sealed to configure the cooler with a plurality of pouches that have a width shorter than the height via longitudinal seals.

While the preferred embodiments of the invention have been shown and described, numerous variations and alternative embodiments will occur to those of ordinary skill in the art. Accordingly, it is intended that the invention not be limited to as described, but also encompass the equivalents of the invention described, as well as any improvements which are obvious to those of ordinary skill in the art. Those of ordinary skill in the art will recognize that the method and product disclosed herein may be readily adapted in a variety of manners.

What is claimed is:

1. A cooler comprising:

a sidewall portion including an outer layer and an inner layer with intersecting vertical and horizontal seals to form a plurality of gel pockets; and gel disposed in the plurality of gel pockets, wherein the cooler is foldable along regions between the gel pockets.

2. The cooler of claim 1 wherein the intersecting vertical and horizontal seals of the outer layer and the inner layer results in a polygonal shape.

3. The cooler of claim 1 further comprising:

a lid including an outer layer and an inner layer with intersecting vertical and horizontal seals to form a plurality of gel pockets.

4. The cooler of claim 3 wherein the lid is sealably connected to the sidewalls.

5. The cooler of claim 4 wherein the connection is selected from the group consisting of a zipper, VELCRO, magnets, clips, and snaps.

6. The cooler of claim 1 further comprising:

a bottom including an outer layer and an inner layer with intersecting vertical and horizontal seals to form a plurality of gel pockets.

7. The cooler of claim 6 wherein the bottom is fixedly attached to the sidewall.

8. The cooler of claim 6 wherein the bottom is attached to the sidewall with a method selected from stitching and hot sealing.

9. The cooler of claim 7 further comprising:

a bottom flap foldable attached to a seam between the bottom and the sidewall.

10. A method for constructing a cooler, the method comprising:

providing an inner wall and an outer wall;

creating a plurality of pouches with the inner and outer walls;

partially filling the pouch with a gel;

creating a first set of gel filled portion by sealing the partially filled pouches to contain the gel;

adding additional gel to the pouches; and creating a second set of gel filled portions by sealing the partially filled pouches to contain the additional gel.

11. The method of claim 10 further comprising:

Creating an additional predetermined number of gel filled portions.

12. The method of claim 10 further comprising the step of creating additional gel filled portions until the pouch is filled with gel.

13. The cooler of claim 1 wherein the inner layer is a temperature resistant plastic.

14. The cooler of claim 1 wherein the foldable regions between gel pockets are heat seals or sonic welds.

* * * * *